United States Patent [19]

Fuscone

[11] 4,114,883

[45] Sep. 19, 1978

[54] DART FLIGHTS

[76] Inventor: Roy Fuscone, 3D Holland Park, London W.11, England

[21] Appl. No.: 613,014

[22] Filed: Sep. 12, 1975

[30] Foreign Application Priority Data

Sep. 12, 1974 [GB] United Kingdom ..... 37998/74

[51] Int. Cl.[2] ..... A63B 65/02

[52] U.S. Cl. ..... 273/106.5 C; 46/30

[58] Field of Search ..... 273/106.5 C, 106.5 R; 46/30

[56] References Cited

U.S. PATENT DOCUMENTS

| | | | |
|---|---|---|---|
| 2,712,200 | 7/1955 | Dearling | 46/30 X |
| 2,844,910 | 7/1958 | Korchar | 46/30 X |
| 3,066,436 | 12/1962 | Schuh | 46/30 |
| 3,384,373 | 5/1968 | Siegler | 273/106.5 R |
| 3,820,294 | 6/1974 | Parker | 46/30 X |

FOREIGN PATENT DOCUMENTS

| | | | |
|---|---|---|---|
| 556,805 | 10/1943 | United Kingdom | 273/106.5 C |
| 628,041 | 8/1949 | United Kingdom | 273/106.5 R |

*Primary Examiner*—Paul E. Shapiro

*Attorney, Agent, or Firm*—Morgan, Finnegan, Pine, Foley and Lee

[57] ABSTRACT

A dart flight comprising first and second interengageable planar pieces each providing two wings of the flight when erected, the first piece having a slot on its longitudinal axis intermediate its ends, the second piece having two slots on its longitudinal axis each opening at a respective end, the slot in the first piece being substantially the same length as the distance between the inner, closed, ends of the slots in the second piece. The flight will not readily fall apart once assembled, and it can be folded flat without significant distortion of the pieces.

11 Claims, 6 Drawing Figures

DART FLIGHTS

This invention relates to dart flights and darts having such flights.

Traditionally, darts may comprise a point, a "barrel" in which the point is fixed, an adaptor screwed to the barrel and a split "cane" wedged into the adaptor. A flight can be slotted into the split cane, and a ferrule on the cane can be moved to clamp the split ends together and retain the flight.

FIG. 1 of the accompanying drawings shows such a construction wherein the point is shown at 10, barrel at 11, the adaptor at 12, the split cane at 13, the flight at 14, and the ferrule at 15. The flight can be made of folded pieces of paper glued together to form the usual four wings, or of moulded plastics material or of plasticised paper. Other proposals include flights moulded integrally with a cane, with the ferrule not provided and in some cases the cane is screw threaded so that adaptor is not required. Another possibility is to use feathers for the flight, attached directly to the cane.

Feathers are expensive, and readily liable to damage and a feather flight cannot be folded. This is a drawback as darts players like to be able to dismantle their darts in order to carry them around in thin flat packs. Both paper and plastics one piece flights can be folded, but when released are unlikely to return to the true position where each wing of the flight is planar and consistently at right angles to the adjacent wings. Even when such paper and plastic flights are not folded, they by their very nature tend to become distorted from the true positions over a period of time. This adversely affects performance. In addition, paper flights are weak and liable to damage.

To avoid these difficulties, two-part flights have been proposed, each part having a slot along its axis extending from one end in one part, and from the other end in the other part. The parts are then engageable to form the required flight, each part providing two wings. The flight can be fixed into the cane as described above. The two parts can be stored flat. However, one undesirable feature of this proposal is that the flights obviously tend to fall apart when removed from the cane. This increases the difficulty of normal handling. Also, the flights tend to fall apart in the not uncommon situation where one dart passes close to another already thrown and sticking into the board and the two flights interfere. One of the advantages of the split cane is that the flight of the thrown dart will in this situation become disengaged so that the rest of the dart can proceed to the board. However, it is undesirable that upon such disengagement the two parts of the flight should fall apart. Another difficulty is that where a dart with a flight of this type is already in the board, another dart of which the point strikes the flight may readily cause damage to the slotted flight, particularly if it encounters the flight in the angle between the wings.

According to the present invention there is provided a dart flight comprising first and second interengageable planar pieces each providing two wings of the flight when erected, the first piece having a slot on its longitudinal axis intermediate its ends, the second piece having two slots on its longitudinal axis, each opening at a respective end, the slot in the first piece being substantially the same length as the distance between the inner, closed, ends of the slots in the second piece.

The flight according to the invention will not readily fall apart into its two constituent pieces, and it can be folded flat without any significant distortion of the pieces. This means that when erected to the position of use, good uniformity of shape along the length of the flight can be expected. The slot in the second piece which opens towards the tail of the flight can be made short, thus reducing the possibility of damage in the case where another dart strikes the flight. Such damage usually arises from contact of the point of the dart in the region of this slot. The length of this slot will be substantially the same as the distance between the end of the central slot in the first piece and the tail end of the first piece. This length can be made as small as possible consistent with adequate strength and governs the minimum length of the tail slot in the second piece of the flight.

Because the flight folds readily without bending there is no need for the pieces to be disassembled when not in use. The slots will be adapted to provide this free rotation without bending and in practice need only be a very slightly wider than the thickness of the material used.

The flight can be made of plastics materials such as polyethylene or polyvinylchloride and preferably of a material which will keep its shape at a variety of temperatures and also if made wet. Clearly, the shape of the wings is not material to the present invention and any desired shape can be used consistent with a capability of assembly.

The invention will be more clearly understood from the following description which is given by way of example only with reference to FIGS. 2 to 6 of the accompanying drawings in which.

Figure 1:
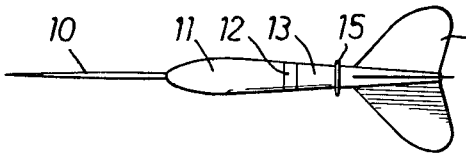
Figure 2:
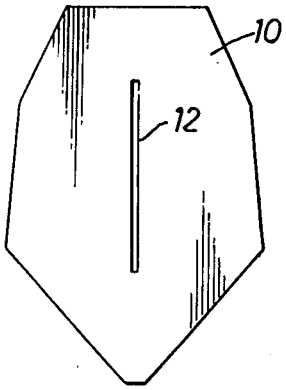
FIGS. 2 and 3 are plan views of first and second pieces of a two-part flight according to the invention.
Figure 3:
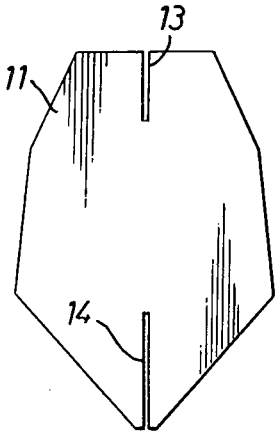

FIGS. 2 and 3 shows two pieces 10 and 11 from which a flight with four wings can be assembled. The pieces are identical except for the disposition of slots upon the longitudinal axes thereof. The piece 10 has a central slot 12 closed at both ends. The piece 11 has an upper or tail slot 13 opening at the tail end of the piece and a lower or leading slot 14 opening at the leading end of the piece. The distance between the slots 13 and 14 is substantially equal to the length of the slot 12, so that when assembled the two pieces will be relatively fixed in the longitudinal direction.

Figure 4:
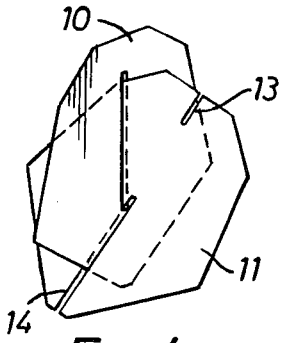
FIG. 4 shows the pieces being assembled.
Figure 5:
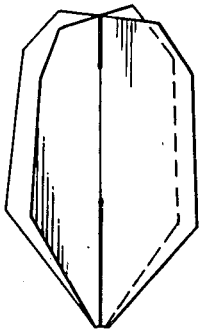
FIG. 5 shows the flight assembled from the two pieces in perspective.

FIG. 4 shows the pieces being assembled. A wing of piece 11 is being inserted through the slot 12 in piece 10 and by suitable manipulation and bending the assembled position shown in FIG. 5 can be achieved. Clearly, for this purpose the central slot 10 must be sufficiently long for one wing of the piece 11 to pass therethrough and the pieces are so shaped that the one wing can pass through the slot with only limited flexure of the two pieces.

The distance between the tail end of the piece 11 and the upper end as shown in FIG. 2 of the slot 12 should be a short as possible consistent with reasonable strength. This means that the slot 13 can be a correspondingly short length and a distance of $\frac{1}{2}$ to 1/16 inch, preferably, $\frac{1}{8}$ inch is suitable.

A flight of the invention can be used with the preferred type of dart employing a split cane and a ferrule to hold the flight in position. It can be made of plastics materials and therefore be durable and the fact that it can be folded will appeal to many darts players. More importantly, advantages accrue from the fact that no distortion of the two pieces need occur when the flight is folded and this will provide uniformity axially of the flight when erected thus leading to good performance.

Figure 6:
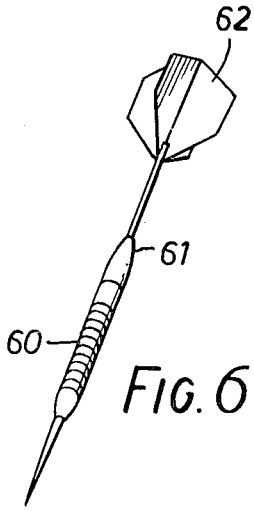
FIG. 6 is a perspective view of a dart equipped with a flight according to the invention.

FIG. 6 shows a dart including a flight according to the invention, the dart having an integral point and barrel 60 and a cane 61 of plastics material screwed into the barrel. The cane has a split end and the flight 62 is inserted thereinto. The flight can be readily inserted and removed from the cane, and can be folded flat upon removal, to be, when required, erected to the square position.

In one suitable embodiment the pieces of the flight are 1 11/16 inches long along their longitudinal axes, the central slot in the one piece being 1¼ inches long. The tail slot in the second piece is ½ inch long, the slot at the leading end 5/16 inch long.

Compared with previously proposed two-piece flights, the flight of the invention has the advantage that it will not readily fall apart and, due to the possibility of the tail slot being short, the chances of damage by other darts are reduced. No adhesive is required in its manufacture, and distortion over a period of time from this source is avoided. The flight can simply be made by being stamped, pressed or molded with the slots provided and then engaged as described above.

I claim:

1. A dart flight comprising first and second interengageable planar pieces each providing two wings of the flight when erected and each being symmetrical about a longitudinal axis, a slot defined along the longitudinal axis of the first piece intermediate its ends, two slots defined along the longitudinal axis of the second piece each opening at a respective end of said axis and having an inner, closed, end, said slot in said first piece having substantially the same length as the distance between said inner, closed ends of said slots in said second piece, whereby said pieces can be engaged with said second piece passing through the slot in said first piece.

2. A dart flight according to claim 1 made of polyethylene.

3. A dart flight according to claim 1 made of polyvinylchloride.

4. A dart flight according to claim 1, wherein the length of the slot at the tail end of the second piece is ¼ to 1/16 inch.

5. A dart flight according to claim 1, wherein the length of the slot at the tail end of the second piece is ⅛ inch.

6. A dart flight according to claim 1 wherein the edges of the interengageable planar pieces are so shaped that one wing can pass through the slot of the other wing with only limited flexure of the two pieces.

7. A dart flight according to claim 1 wherein the interengageable planar pieces are of equal length.

8. A dart provided with a dart flight comprising first and second interengaged planar pieces, a dart flight comprising first and second interengageable planar pieces each providing two wings of the flight when erected and each being symmetrical about a longitudinal axis, a slot defined along the longitudinal axis of the first piece intermediate its ends, two slots defined along the longitudinal axis of the second piece each opening at a respective end of said axis and having an inner, closed, end, said slot in said first piece having substantially the same length as the distance between said inner, closed ends of said slots in said second piece, said pieces being engaged with said second piece passing through the slot in said first piece.

9. A dart flight according to claim 8 wherein the interengageable planar pieces are of equal length.

10. A dart flight according to claim 8 that is made of polyethylene.

11. A dart flight according to claim 8 that is made of polyvinylchloride.

* * * * *

UNITED STATES PATENT AND TRADEMARK OFFICE

CERTIFICATE OF CORRECTION

PATENT NO. : 4,114,883
DATED : September 19, 1978
INVENTOR(S) : Roy Fuscone

It is certified that error appears in the above-identified patent and that said Letters Patent are hereby corrected as shown below:

In Column 4, line 9, "1/4" should be --1/2--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*